US005238415A

United States Patent [19]

Bittner et al.

[11] Patent Number: 5,238,415

[45] Date of Patent: Aug. 24, 1993

[54] MULTIWAY CONNECTOR FOR MAKING COMMON ELECTRICAL CONTACT WITH SEVERAL ELECTRICALLY ENERGIZABLE UNITS OF INTERNAL COMBUSTION ENGINES

[75] Inventors: Johann Bittner, Ditzingen; Helmut Bassler, Weinstadt; Thomas Naeger, Stuttgart, all of Fed. Rep. of Germany

[73] Assignee: Robert Bosch GmbH, Stuttgart, Fed. Rep. of Germany

[21] Appl. No.: 776,342

[22] PCT Filed: Mar. 22, 1991

[86] PCT No.: PCT/DE91/00257

§ 371 Date: Nov. 22, 1991

§ 102(e) Date: Nov. 22, 1991

[87] PCT Pub. No.: WO91/17357

PCT Pub. Date: Nov. 14, 1991

[30] Foreign Application Priority Data

Apr. 27, 1990 [DE] Fed. Rep. of Germany ..... 4013537

[51] Int. Cl.[5] ..... H01R 13/447

[52] U.S. Cl. ..... 439/130; 123/468

[58] Field of Search ..... 439/130; 123/468, 470

[56] References Cited

U.S. PATENT DOCUMENTS 4,950,171 8/1990 Muzsclay ..... 439/130 X

*Primary Examiner*—Eugene F. Desmond

*Attorney, Agent, or Firm*—Edwin E. Greigg; Ronald E. Greigg

[57] ABSTRACT

A multiway connector comprising a support part and a cover part including plugs. The plugs with the first electrically conducting contact elements and electrical conductors are arranged on the support part. The two-part construction of the multiway connector permits a problem-free mounting of the electrical conductors in the vicinity of a support part front face, for example, in guide grooves of the support part. The construction of the multiway connector is particularly suitable for the joint electrical contacting of electrically operable fuel injection valves.

17 Claims, 6 Drawing Sheets

MULTIWAY CONNECTOR FOR MAKING COMMON ELECTRICAL CONTACT WITH SEVERAL ELECTRICALLY ENERGIZABLE UNITS OF INTERNAL COMBUSTION ENGINES

STATE OF TECHNOLOGY

The invention is based on a multiway connector of the type described hereinafter. A device is known from DE-OS 37 30 571, in which the fuel injection valves are positioned in individual locating apertures of a fuel distributor piece and which are jointly contacted, electrically, by means of a multiway connector. A number of plugs, corresponding to the number of fuel injection valves, in which are fixed first electrically conducting contact elements which are connectable with second electrically conducting contact elements of the fuel injection valves, are arranged together on the multiway connector. The electrical conductors which connect the electrical connection plug of the multiway connector with the first electrically conducting contact elements, are arranged within the multiway connector. The one-piece design of the multiway connector has the disadvantage that mounting the flexible assembly, which consists of the first electrically conducting contact elements and the electrical conductors, on the multiway connector, e.g. by encapsulating it in the multiway connector which is made of plastic material, is a very elaborate and difficult process. If moreover a large number of electrical conductors is required, namely when the electrically energizable units which are contacted by the common multiway connector are to be energized at different instants rather than simultaneously, then it is particularly laborious and complicated to mount the flexible assembly.

A secure and reliable connection of the first electrically conducting contact elements and the electrical conductors with the multiway connector is not always ensured. In addition, there is the risk of damage to the first electrically conducting contact elements, the electrical conductors, and the connections between the electrical conductors and the electrically conducting contact elements.

ADVANTAGES OF THE INVENTION

In contrast, the multiway connector in accordance with the invention has the advantage of a simple and economic manufacture. The configuration of the two-piece multiway connector by way of a support part and a cover part, facilitates the straightforward arrangement of the electrical conductor on the support part, thereby not only substantially reducing the mounting effort, but also improving the access to the electrical conductors, the first electrically conducting contact elements and the plugs. The risk of damage to the first electrically conducting contact elements, the electrical conductors, and the connections between the electrical conductors and the first electrically conducting contact elements, is significantly reduced by virtue of the simplified handling and mounting.

Advantageous developments and improvements of the multiway connector specified herein are made possible by the measures listed.

It is of advantage, if the plug connections can float in the horizontal and vertical directions with the support part, so that compensation of the shape and position tolerances between the jointly contacted electrically energizable units and the multiway connector is made possible.

It is of particular advantage for the compensation of the shape and position tolerances between the electrically energizable units and the multiway connector, if the support part has fixing domes along a support axis, the number of which corresponds to the number of plugs, with which the plugs are floatably connected in the direction of a dome longitudinal axis and vertical to the same.

In this arrangement, it is of advantage, if every fixing dome has at least one transverse groove which extends in the direction of the dome longitudinal axis which is open towards a dome front face provided on the free dome end and towards the dome circumference, this groove permitting an elastic compression of the free dome end in radial direction when the plug is pushed onto the fixing dome, so that a snap-in nose provided on the plug or on the fixing dome can engage with a locating groove provided on the plug or on the fixing dome, such that the plug is movable in relation to the fixing dome in the direction of the dome's longitudinal axis and vertically in relation to the same. This then results in a particularly simple connection of plug and support part, which at the same time permits movability of the plug in relation to the support part.

For a simple mounting of the plug on the fixing dome, it is advantageous if the snap-in nose and the locating groove are of annular design.

To make the design of the support part and the plugs arranged on it as simple as possible, it is advantageous if the plugs are configured rigidly connected with the support part.

It is particularly advantageous, if the electrical conductors are arranged on a support part front face which faces the bottom of the cover part, so that a simple arrangement of the electrical conductors on the support part and a problem-free connection of the electrical conductors to the first electrically conducting contact elements is obtained.

For the fixing of the electrical conductors on the support part, it is advantageous, if the electrical conductors are pressed into the guide grooves designed in the support part, if the electrical conductors in the support part are encapsulated, or if the electrical conductors are held to the support part by means of holding elements. In this way, the electrical conductors on the support part can be fixed securely and reliably, and in a simple manner.

It is further advantageous if the support part, together with the plugs which have the first electrically conducting contact elements and which are arranged on it, and with the electrical conductors also arranged on the support part, form a pre-assembled rigid assembly, which is at least partly covered by the cover part. The pre-assembled rigid assembly not only permits greater flexibility in manufacture, but also reduces the risk of damage to the first electrically conducting contact elements, the electrical conductors, and the connections between the first electrically conducting contact elements and the electrical conductors. The partial covering of the pre-assembled rigid assembly by the cover part protects the assembly during operation; the cover part itself can be of very simple design.

In such an arrangement, it is of advantage if the cover part covers a support part front face, in the vicinity of which the electrical conductors extend. In this way, the electrical conductors, the first electrically conducting contact elements, and the connections between conductors and contact elements, can be protected from external influences during operation.

It is further of advantage if the cover part is 'U' shaped and the support part is covered on three sides, so as to provide protection from external influences, not only for the first electrically conducting contact elements and the electrical conductors, but also for the support part with the plugs as a whole, and if appropriate, part of the electrically energizable units with their second electrically conducting contact elements.

It is of particular advantage if the cover part and the support part are connected with each other by an elastic snap-in connection, which is particularly quickly and easily made during assembly.

For a particularly secure and reliable connection between cover part and support part, it is advantageous if the cover part and the support part are connected with each other by means of ultrasonic welding.

It is further advantageous if the cover part is designed as a plastic casing around the support part, so that a particularly compact multiway connector is obtained which can also be manufactured in a simple manner.

In order to prevent fuel and other external influences from reaching the electrical conductors, it is advantageous if the support part is tightly connected with the cover part.

DRAWING

Embodiment examples of the invention are shown simplified in the drawing and are described in more detail below.

DESCRIPTION OF THE EMBODIMENT EXAMPLES

Figure 1:
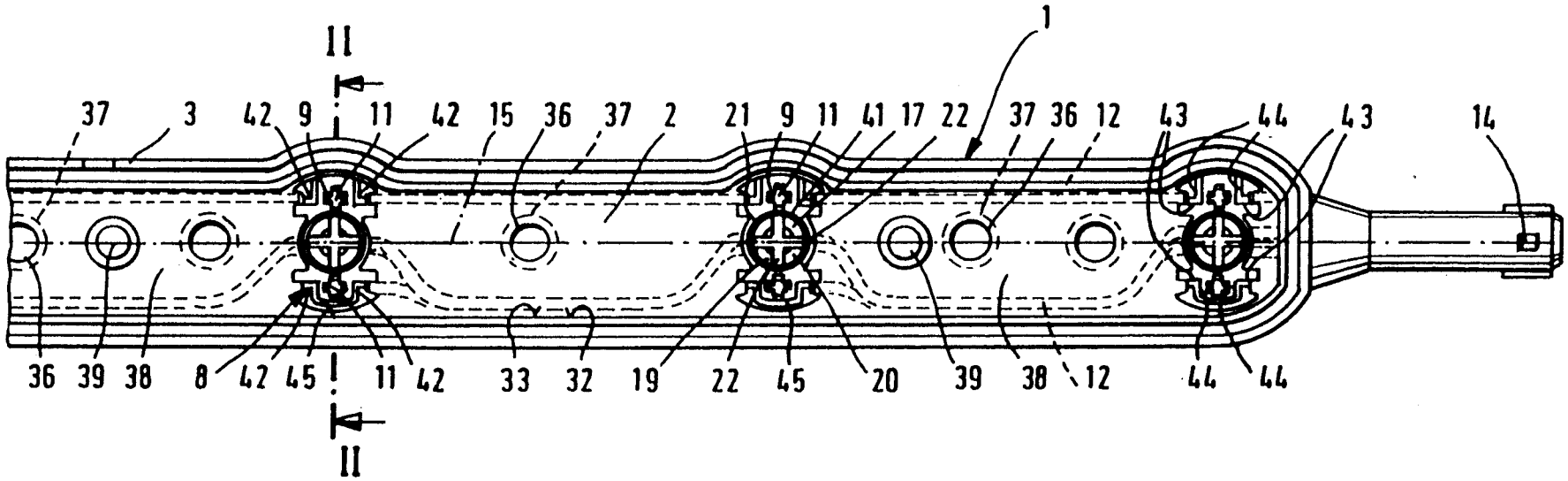
FIG. 1 shows a partial view of a first embodiment example.

In the multiway connector shown by way of examples in FIGS. 1 to 6, for the electrical contacting of several electrically energizable units of internal combustion engines, in particular the fuel injection valves, the multiway connector is designated 1. The multiway connector 1 is formed of a support part 2 and a cover part 3. In the embodiment example shown in FIGS. 1 and 2, plugs 8 are arranged on the support part 2, which are assigned to one electrically energizable unit each, and which serve to provide the electrical contact to the same. The plug 8 which is made of electrically insulating material has, for example, two plug apertures 9 which are stepped and open to both sides, in each of which there is a first electrically conducting contact element 11 which is snap connected by means of snap-in noses 10 on the first electrically conducting contact element 11. The first electrically conducting contact elements 11 are conductively connected at one end 11', for example by a clamp and/or soldered connection, to electrical conductors 12 which are arranged on the support part 2. The opposite end 11" is connected to a contact on a fuel injector when assembled onto a fuel injector. For example, a connection plug 14 is arranged on the multiway connector 1 on one of the ends in longitudinal direction, to which the electrical conductors 12 are connected and via which electrical drive signals can be input from an electronic control unit, not shown here, for the electrically energizable units. All electrical conductors 12, starting from the connection plug 14, thus run to the individual plugs 8 within the multiway connector 1 from where they branch out to the individual first electrically conducting contact elements 11.

Figure 2:
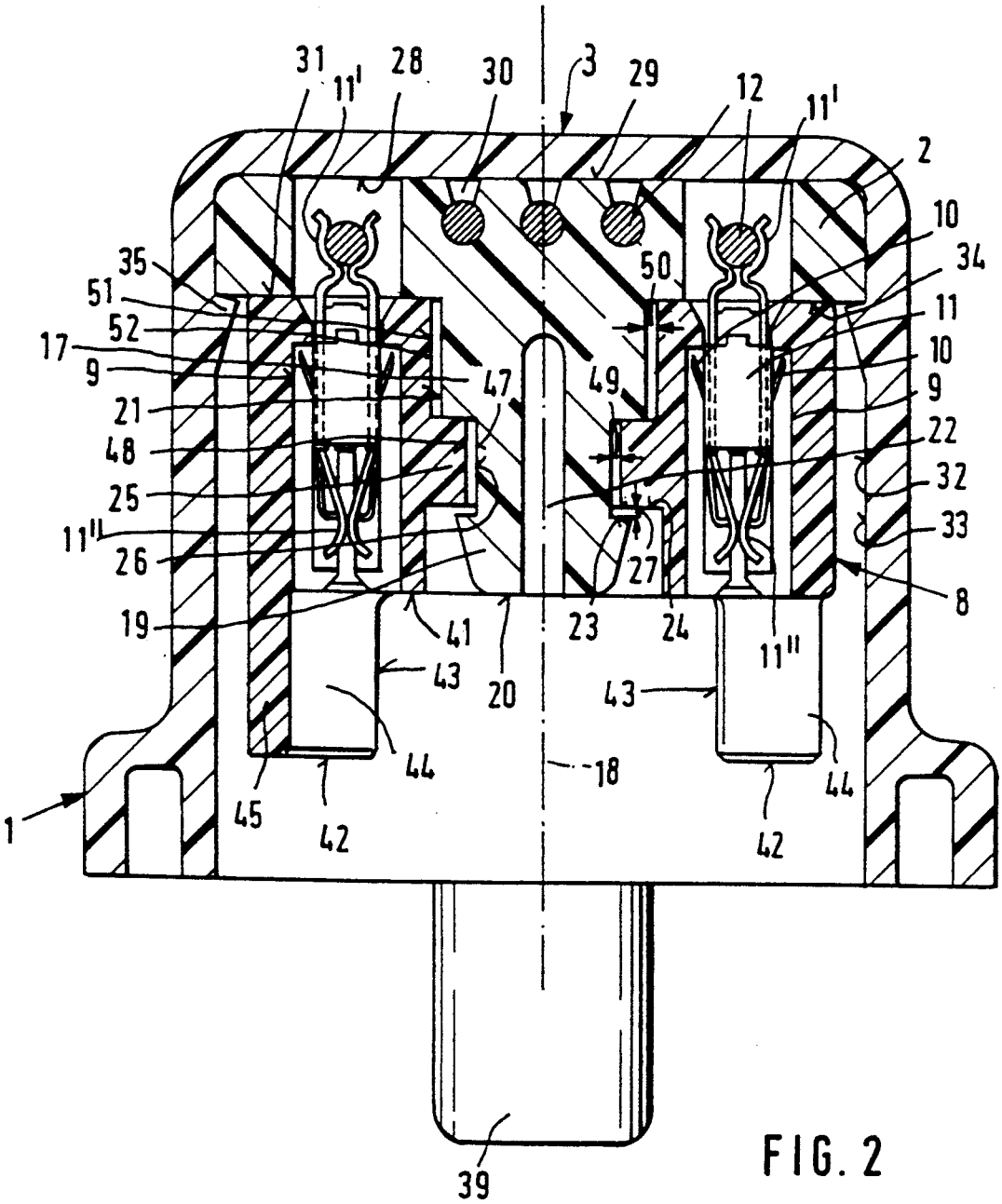
FIG. 2 shows a section along II—II in FIG. 1.

In the embodiment example shown in FIGS. 1 and 2, the individual plugs 8 are floatably connected in horizontal and vertical direction, to the support part 2. In this way, form and position tolerances between the jointly contacted and electrically energizable units and the multiway connector 1 can be compensated, since the plugs 8 which are still movable after being mounted on the support part 2, can align themselves according to the position of second electrically conducting contact elements of the electrically energizable units on the support part 2. The risk of deformation and damage to the first electrically conducting contact elements 11, the second electrically conducting contact elements, the electrically energizable units and/or the plugs 8, is thus significantly reduced. For this purpose, the support part 2 has along the support's longitudinal axis 15 a number of fixing domes 17 which corresponds to the number of plugs 8. Each of the fixing domes 17 has four transverse grooves 22 which extend in the direction of a dome's longitudinal axis 18 and which are open towards a dome front face 20, which is provided on the free dome end 19, and towards the dome circumference 21, which intersect in the vicinity of the dome's longitudinal axis 18. When the plugs 8 are pushed onto the fixing dome 17, the transverse grooves 22 permit an elastic compression of the free dome end 19, so that an annular snap-in nose 25 provided on the plug 8 can engage with an annular snap-in groove 26, which is arranged, for example, on the fixing dome 17, in such a way that the plug 8 is still movable with some clearance opposite the fixing dome 17 in the direction of the dome's longitudinal axis 18 and vertically in relation to the same. For this purpose, an axial separation 27 is provided between a groove side face 23, which faces the dome front face 20, of the snap-in groove 26 and a nose shoulder 24, which faces a cover base 28 of the cover part 3, of the snap-in nose 25 of the plug 8, so that the plug 8 has play in relation to the fixing dome 17 and thus opposite the support part 2, in an axial or vertical direction. Facing the cover base 28 is a support part front face 29. The radial separation 27 is limited by the facial contact of a plug front face 31 of the plug 8, which faces the cover base 28, on a support part shoulder 34 of the support part 2 which faces away from the support part front face 29.

It is further possible to connect the plugs 8 with the support part 2 in a different manner, to be movable in horizontal and vertical direction.

Radial play 49 is provided between the groove root 47 of the locating groove 26 and a clearance width 48 of the snap-in nose 25. Radial play 50 is also provided between a clearance width 51 of a plug step 52 and the dome circumference 21. This leaves the plug 8 freely movable in the radial and horizontal directions in relation to the fixing dome 17, and also in relation to the support part 2.

It is further possible to arrange the snap-in nose 25 on the fixing dome 17, and to arrange the snap-in groove 26 on the plug 8.

In the first embodiment example shown in FIGS. 1 and 2, the electrical conductors are pressed in guide grooves 30 which are formed in the support part front face 29 of the support part 2, if they do not serve directly to provide the means of electrical contact to the first electrically conducting contact elements 11.

The support part 2, the plugs 8, which are arranged on the support part 2 and which have the first electrically conducting contact elements 11, and the electrical conductors 12 which are arranged on the support part 2, form a preassembled rigid assembly which enables greater flexibility in the manufacture. Moreover, the risk of damage to the first electrically conducting contact elements 11, the electrical conductors 12, and the connections between the first electrically conducting contact elements 11 and the electrical conductors 12, is reduced.

In the first embodiment example, the cover part 3 is designed as a 'U' shape and covers the support part 2 on three sides. This provides protection from external influences not only for the first electrically conducting contact elements 11 and the electrical conductors 12, but also for the support part 2 complete with the plugs 8, and the heads, which have the second electrically conducting contact elements of the electrically energizable units. On the two side walls 32 of the cover part 3, which run parallel to each other over wide ranges, at least one elastic snap-in nose 35 is provided on the inner side faces 33, which face each other, of the side walls 32, which in interaction with the support part shoulder 34 of the support part 2 forms a snap-in connection which can be made quickly and simply. It is further possible for the elastic snap-in noses 35 to be formed on support flanks 40 of the support part 2, which face the inner side faces 33, and for snap-in grooves to be formed in the inner side faces 33 of the cover part 3.

For the connection of the multiway connector 1 with a fuel distributor item, for example, or an inlet manifold, or a cylinder head of an internal combustion engine, fixing bushes 37 of a metallic material are moulded in during manufacture, which have a longitudinal hole 36 and which are open on at least one bottom face 38 of the support part 2 which faces away from the cover base 28. The fixing bushes 37 may be internally threaded. In addition, at least two guide arms 39 are moulded on the support part 2, preferably during the manufacture of the support arm 2, on the bottom face 38 of support part 2, protruding with axial separation from the bottom face 38. The guide arms 39 are used for the simplified precise mounting of the multiway connector 1, with the fuel distributor item, the inlet manifold, or the cylinder head of the internal combustion engine, having locations for the guide arms 39.

In FIGS. 1 to 4 and 6, four positioning noses 42 with a multi-corner cross-section are moulded onto a plug front face 41, which faces away from the cover base 28 of the cover part 3, of the plug 8, arranged with separation from one another such that two each of these are on one side of the support part's longitudinal axis 15, namely symmetrically with line II—II which extends through the first electrically conducting contact elements 11. The positioning noses 42, for example, have the form of a right angle and, in longitudinal direction of the multiway connector 1, they have parallel faces 43 and, vertically to the same, they have parallel faces 44. A connecting bridge 45 is formed on the plug 8 which connects the two positioning noses 42, which lie on one side of the support's longitudinal axis 15, at their ends which face away from the support's longitudinal axis 15, so that their two faces 44 are shorter than those faces 44 which extend on the other side of the support's longitudinal axis 15 which terminate open at the end of the plug 8, that is, the faces 44 and thus the positioning noses 42 in relation to the support's longitudinal axis 15 of the multiway connector 1 being constructed asymmetrically to each other on different sides of the support's longitudinal axis 15.

The construction of the plug 8 which is asymmetric relative to the support's longitudinal axis 15, as conditioned by the connecting bridge 45, and the corresponding construction of an upper housing part of the electrically energizable unit, characterized by recesses into which the positioning noses 42 will engage, effect an efficient protection against confusion of poles for the electrically energizable unit, so that this unit when turned through 180° cannot be connected with the plug 8 or the multiway connector 1.

Figure 3:
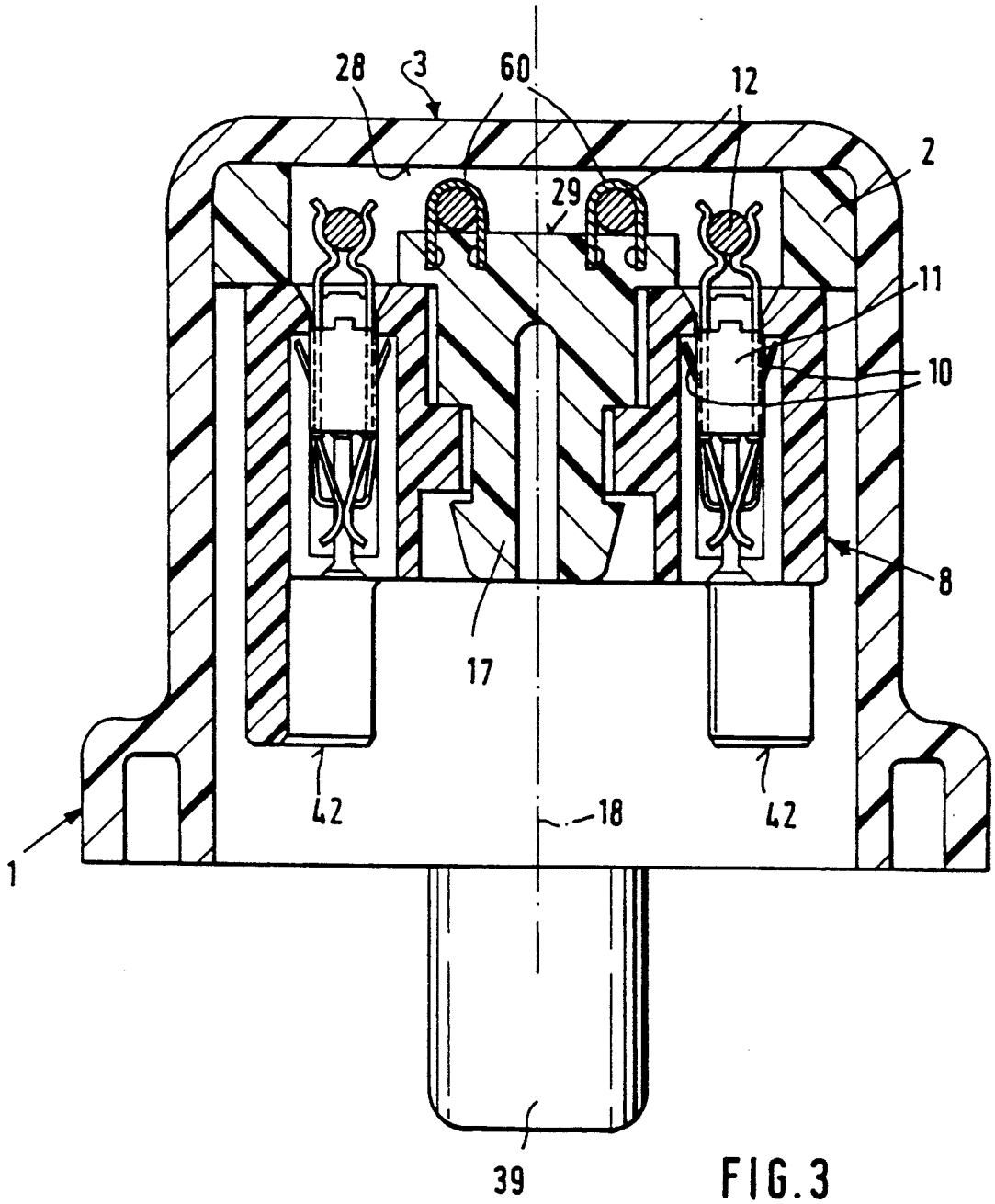
FIG. 3 shows a second embodiment example.

In FIG. 3, a second embodiment example of the invention is shown, in which the same parts and parts with the same action are essentially characterized by the same reference sign as in FIGS. 1 and 2. The electrical conductors 12, which connect the connecting plug 14—not shown—of the multiway connector 1 with the first electrically conducting contact elements 11 of the plug 8, are fixed on the support part front face 29 of the support part 2 by means of holding elements 60 which are connected with the support part 2. This there-fore provides the opportunity of responding in a flexible manner to the number of electrical conductors 12 during manufacture.

Figure 4:
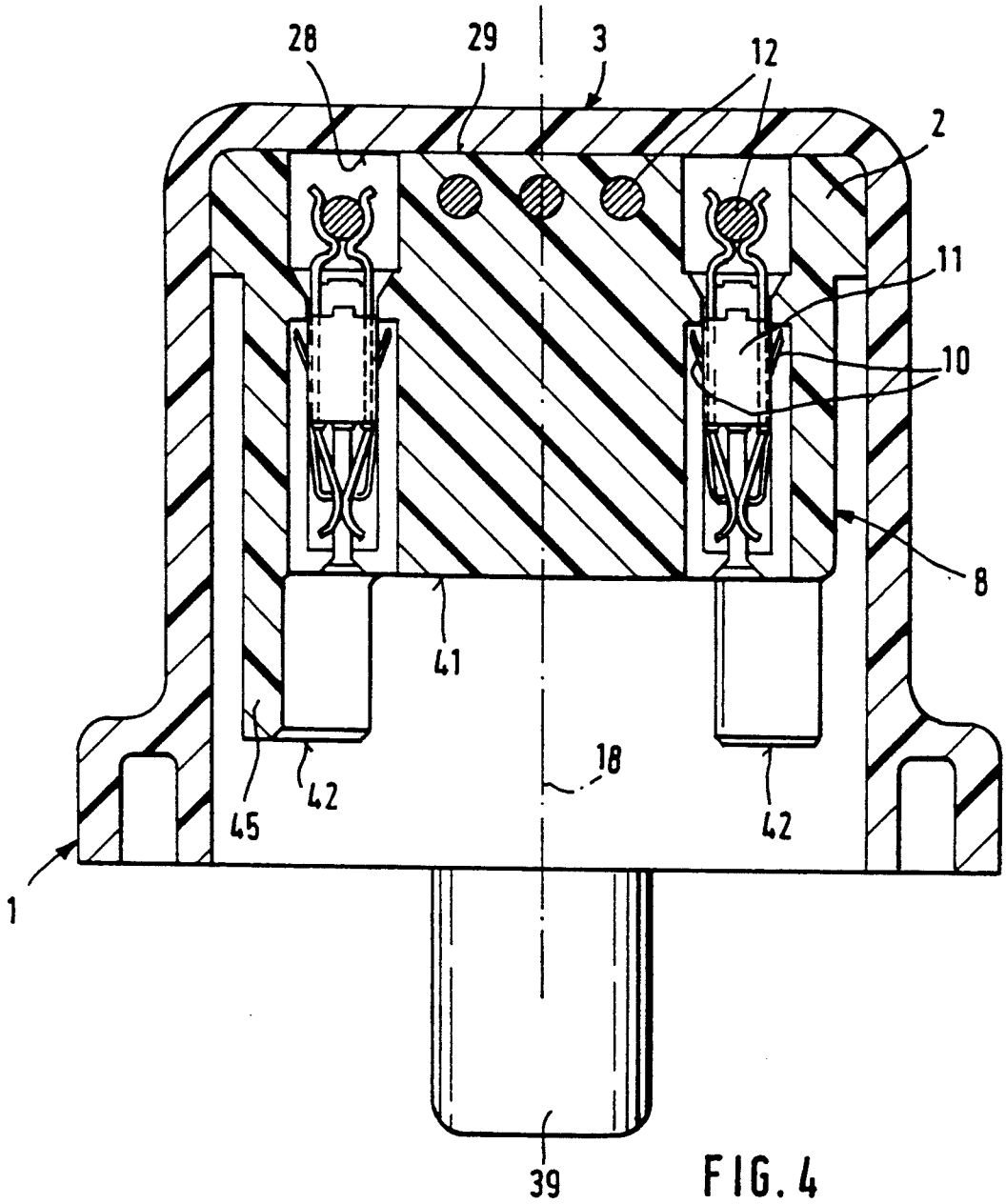
FIG. 4 shows a third embodiment example.

FIG. 4 shows a third embodiment example of the invention with electrical conductors 12 encapsulated in the support part 2 in the vicinity of the support part front face 29. This construction enables a particularly secure and reliable arrangement of the electrical conductors 12 on the support part 2. Identical parts and parts with the same action are essentially characterized by the same reference sign as in FIGS. 1 to 3.

The plugs 8 are constructed rigidly connected with the support part 2, resulting in a very simple form of the support part 2 in accordance with the invention, as a jointly shared plastic injection moulded part. Moulded onto the plug front face 41 of the plug 8, which is integral with the support part 2, are four positioning noses 42, which serve for the positioning of multiway connector 1 and electrically energizable units, one to another.

In contrast to the first embodiment example shown in FIGS. 1 and 2, the 'U' shaped cover part 3 which covers the support part 2 on three sided has no snap-in noses 35 on its inner side faces 33 in the second embodiment example shown in FIG. 3 and in the third example shown in FIG. 4. The pre-assembled rigid assembly which consists of the support part 2, the plugs 8 which have the first electrically conducting contact elements 11, and the electrical conductors 12, is connected instead with the cover part 3 by means of ultrasonic welding. It is further possible to surround the pre-assembled rigid assembly partially with a plastic shell constructed as a cover part 3, resulting in a particularly compact multiway connector which can be manufactured in a simple manner.

Figure 5:
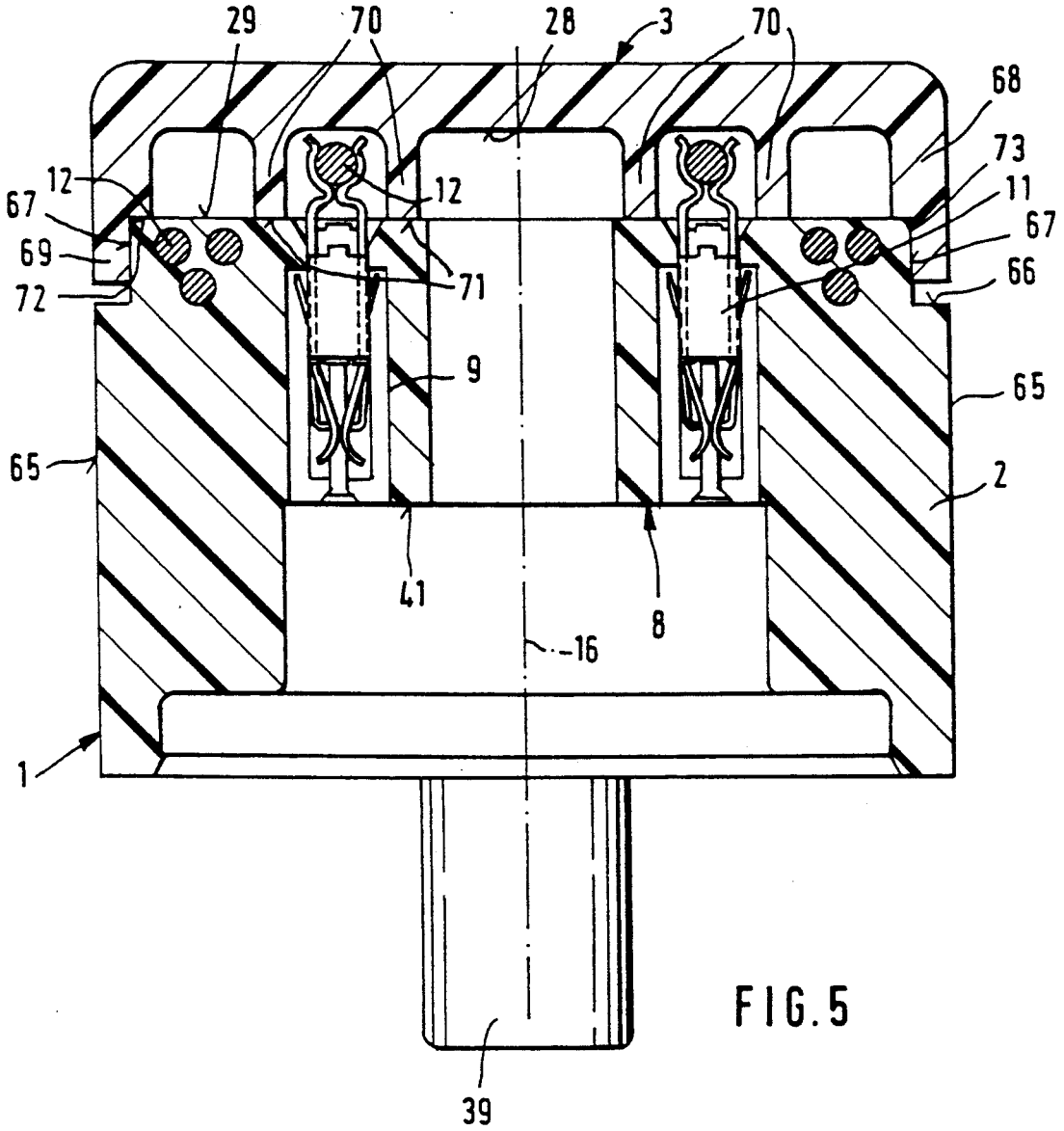
FIG. 5 shows a fourth embodiment example.
Figure 6:
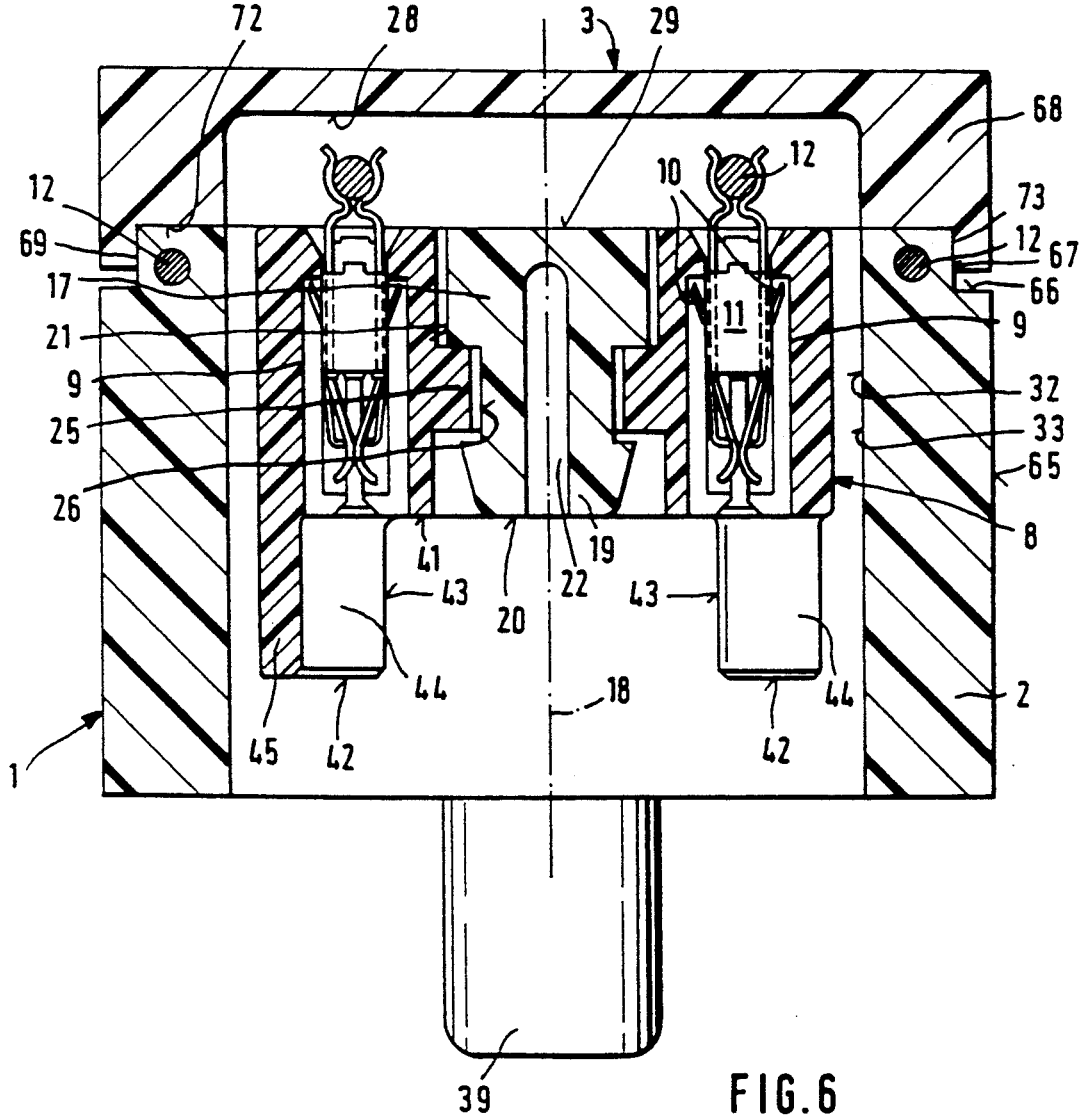
FIG. 6 shows a fifth embodiment example.

FIGS. 5 and 6 show further embodiment examples of the invention, in which the same parts and parts with the same action are essentially characterized by the same reference sign as in the FIGS. 1 to 4.

In the fourth embodiment example shown in FIG. 5, the pre-assembled assembly which consists of support part 2, the plugs 8 which have the first electrically conducting contact elements 11, and the electrical conductors 12, is covered by the cover part 3 only in the vicinity of the support part front face 29 of the support part 2. On the two outer side faces 65 of the support part 2, a holding step 66 is provided on their ends which face the support part front face 29, which has a holding side face 67 constructed parallel with a plug longitudinal axis 16 or a dome longitudinal axis 18. The separation between the two holding side faces 67 is smaller than the separation between the two outer side faces 65 of the support part 2. The cover part 3 embraces the holding side faces 67 of the support part 2 with a cover rim 69 each formed on its cover side parts 68. The cover part 3 rests with one contact face 72 each, constructed on the cover edges 69, of a cover step 73 against the front face 29 of the support part 2. Cover part 3 and support part 2 are connected with each other by means of ultrasonic welding, for example.

On the cover base 28 of the cover part 3, four longitudinal bridges 70 are formed, two of which in each case embrace a first electrically conducting contact element 11, so that this and the electrical conductor 12 is extensively protected from external influences. In this arrangement, it is possible that the longitudinal bridges 70 are resting against the front face 29 with their front faces 71 which face the support part 2. The electrical conductors 12—if they do not serve the immediate contact to the first electrically conducting contact elements 11—are encapsulated with the support part 2, in the vicinity of the front face 29 and are thus securely and reliably fixed in their position. The plugs 8 are rigidly connected with the support part 2, enabling the support part 2 and the plug 8 to be manufactured as one plastic injection moulded part, simply and economically. In the fourth embodiment example, the design of positioning noses 42 and connecting bridge 45 on the plug front face 41 was dispensed with.

In the fifth embodiment example shown in FIG. 6, the plugs 8 are connected with the support part 2 in the same way as shown in the embodiment examples of FIGS. 1, 2, and 3, and they have on their plug front face 41 the positioning noses 42 and the connection bridge 45 which are for the purpose of positioning the multiway connector 1 relative to the electrically energizable units. The support part 2 has fixing domes 17, the number of which corresponds to the number of plugs 8, onto which the plugs 8 are pushed and fixed in such a way that the plugs 8 are movable relative to the particular fixing dome 17 in the direction of the dome's longitudinal axis 18 and vertically in relation to the same. The pre-assembled assembly which consists of support part 2, the plugs 8 which have the first electrically conducting contact elements 11, and the electrical conductors 12, is covered by the cover part 3 only in the area of the front face 29 of support part 2. As described in the fourth embodiment example, the cover part 3 embraces the holding side faces 67 of the support part 2 with a cover rim 69 each formed on its cover side parts 68. The cover part 3 rests with the contact faces 72, constructed on the cover edges 69, of a cover step 73 against the front face 29 of the support part 2. Cover part 3 and support part 2 are connected to each other by means of ultrasonic welding, for example. The electrical conductors 12 are encapsulated in the support part 2 in the vicinity of the front face 29 and are thus securely fixed in their position. It is further possible to arrange for the electrical conductors 12 to be fixed by means of clips in the holding grooves of support part 2 or by means of holding elements on the front face 29 of the support part 2.

The two-part construction of the multiway connector 1, support part 2 and the cover part 3, in accordance with the invention, permits a simple and economic manufacture. The electrical conductors 12 can be securely and reliably fixed on the support part 2, requiring only a small amount of work, so that the risk of damage to the first electrically conducting contact elements 11, the electrical conductors 12, and the connections between the electrical conductors 12 and the first electrically conducting contact elements 11 is significantly reduced.

If the multiway connector 1 serves to provide the electrical contact to fuel injection valves, then the fuel injection valves can be arranged, for example, within a fuel distributor item, in an inlet manifold, or directly in a cylinder head, if connection sleeves and lines for fuel supply are provided. The injection of fuel can be made both into the inlet manifold and directly into the cylinder of the internal combustion engine.

The multiway connector 1 in accordance with the invention is of course equally suitable for providing electrical contact to sparking plugs of a remote internal combustion engine or to the glow plugs of a self-ignition internal combustion engine.

The foregoing relates to a preferred exemplary embodiment of the invention, it being understood that other variants and embodiments thereof are possible within the spirit and scope of the invention, the latter being defined by the appended claims.

We claim:

1. A multiway connector (1) for joint electrical contacting of several electrically energizable units of internal combustion engines, which comprises separate plugs (8) arranged in said multiway connector, each of said separate plugs have at least two plug apertures (9), a separate first electrically conducting contact element (11) is arranged in each of said plug apertures which is connected at one end (11'') to separate electrically conducting contact elements of a separate electrically energizable unit by means of a plug contact connection, and a second end (11') of each of said first electrically conducting contact elements is connected with one of at least two separate electrical conductors which electrically connect the first electrically conducting contact elements of the separate plugs to at least one electrical contact of an electrical connection plug (14) moulded onto the multiway connector and which are arranged within the multiway connector, the multiway connector (1) is formed of a support part (2), a cover part (3), the plugs (8) and the electrical conductors (12) whereby said plugs (18) and said electrical conductors (12) are arranged on the support part (2).

2. A multiway connector in accordance with claim 1, in which the support part (2); the plugs (8), having the first electrically conducting contact elements arranged on that support part; the electrical conductors (12) arranged on the support part (2), form a pre-assembled rigid assembly which is at least partially covered by the cover part (3).

3. A multiway connector in accordance with claim 2, in which the cover part (3) covers a front face (29) of the support part (2), in the vicinity of which the electrical conductors (12) extend.

4. A multiway connector in accordance with claim 2, in which the cover part (3) is designed in a 'U' shape and that the support part (2) is covered on three sides.

5. A multiway connector in accordance with claim 1, in which the cover part (3) and the support part (2) are connected which each other by means of an elastic snap-type connection.

6. A multiway connector in accordance with claim 1, in which the support part (2) and the cover part (3) are connected to each other by means of ultrasonic welding.

7. A multiway connector in accordance with claim 1, in which the cover part (3) is constructed as a plastic shell around the support part (2).

8. A multiway connector in accordance with claim 1, in which the support part (2) is tightly connected with the cover part (3).

9. A multiway connector in accordance with claim 1, in which the plugs (8) are connected floatably in horizontal and vertical directions with the support part (2).

10. A multiway connector in accordance with claim 9, in which the support part (2) has fixing domes (17) along a support part longitudinal axis (15), the number of which corresponds to the number of plugs, with which the plugs (8) are floatably connected in the direction of a dome longitudinal axis (18) and vertically in relation to the same.

11. A multiway connector in accordance with claim 10, in which each fixing dome (17) has at least one transverse groove (22) which extends in the direction of the dome longitudinal axis (18), which is open towards a dome front face (20) provided on the free dome end (19) and towards the dome circumference (21), this groove permitting an elastic compression of the free dome end (19) in a radial direction when the plug (8) is pushed onto the fixing dome (17), so that a snap-in nose (25) provided on the plug (8) or on the fixing dome (17) can engage with a locating groove (26) provided on the plug (8) or on the fixing dome (17), such that the plug (8) is movable in relation to the fixing dome (17) in the direction of the dome's longitudinal axis (18) and vertically in relation to the same.

12. A multiway connector in accordance with claim 11, in which both the snap-in groove (26) and snap-in nose (25) are of annular construction.

13. A multiway connector in accordance with claim 1, in which the plug (8) is rigidly connected with the support part (2).

14. A multiway connector in accordance with claim 1, in which the electrical conductors (12) are arranged on a front face (29) of the support part (2) which faces a cover base (28) of the cover part (3).

15. A multiway connector in accordance with claim 1, in which the electrical conductors (12) are pressed into guide grooves (30) which are formed within the support part (2).

16. A multiway connector in accordance with claim 1 in which the electrical conductors (12) are encapsulated within the support part (2).

17. A multiway connector in accordance with claim 1, in which the electrical conductors (12) are held on the support part (2) by means of holding elements (60).

* * * * *